US007835660B2

(12) United States Patent
Suzuki

(10) Patent No.: US 7,835,660 B2
(45) Date of Patent: Nov. 16, 2010

(54) IMAGE FORMING APPARATUS AND IMAGE FORMING METHOD

(75) Inventor: Shiroh Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 587 days.

(21) Appl. No.: 11/785,172

(22) Filed: Apr. 16, 2007

(65) Prior Publication Data

US 2009/0175647 A1 Jul. 9, 2009

(30) Foreign Application Priority Data

Jul. 28, 2006 (JP) ..... P.2006-206865

(51) Int. Cl.
*G03G 21/20* (2006.01)

(52) U.S. Cl. ..... 399/92

(58) Field of Classification Search ..... 399/92, 399/94, 119, 120, 262
See application file for complete search history.

(56) References Cited

U.S. PATENT DOCUMENTS 5,166,727 A * 11/1992 Miyamoto et al. ..... 399/92
5,838,456 A * 11/1998 Wagi et al. ..... 399/119 X
6,141,512 A * 10/2000 Nagano et al. ..... 399/92
6,701,104 B2 * 3/2004 Chikano ..... 399/92
6,922,537 B2 * 7/2005 Iikawa et al. ..... 399/92
7,110,694 B2 * 9/2006 Ito ..... 399/92
7,136,613 B2 * 11/2006 Sato et al. ..... 399/92 X
7,305,201 B2 * 12/2007 Kimura ..... 399/92
7,403,731 B2 * 7/2008 Mori ..... 399/92

FOREIGN PATENT DOCUMENTS

JP 7-20753 A 1/1995
JP 2001-144889 5/2001

* cited by examiner

*Primary Examiner*—Sandra L Brase
(74) *Attorney, Agent, or Firm*—Morgan, Lewis & Bockius LLP

(57) ABSTRACT

An image forming apparatus is provided and includes: an image formation unit that forms an image on a recording medium with a color material; a color material container that contains the color material; and a cooling air passage that a cooling air for cooling the color material container flows through, the color material container comprising at least a part of the cooling air passage.

6 Claims, 6 Drawing Sheets

IMAGE FORMING APPARATUS AND IMAGE FORMING METHOD

CROSS-REFERENCE TO RELATED APPLICATION

This application is based on and claims priority under 35 USC §119 from Japanese Patent Application No. 2006-206865 filed Jul. 28, 2006.

BACKGROUND (i) Technical Field

This invention relates to an image forming apparatus such as a printer and a copier, and an image forming method.

(ii) Related Art

As image forming apparatuses to be used as a printer, a copier, and the like, an image forming apparatus forming an image on a recording medium using a color material has been known.

Such image forming apparatus has a function unit (heat generating function unit) that generates heat along with a function of a power source device or various electric substrates as well as a function unit such as an optical system for which the temperature increase is undesirable. Therefore, it is necessary to have a structure for preventing the temperature increase due to the heat from the heat generating unit in machinery units other than the heat generating unit.

As the image forming apparatus, one provided with a container containing a color material and has a structure of supplying the color material from the container to an image formation part has been known. In the image forming apparatus having such structure, a defect such as an alternation of the contained color material due to a temperature increase can occur when the color material container is heated by heat from a heat generating function unit.

For instance, an image forming apparatus employing the electrophotography method uses a heat fixing toner as the color material, which is fixed to a recording medium by heat-fixation, and such heat fixing toner is subject to a defect of degradation in fluidity due to a temperature increase.

SUMMARY

According to one aspect of the invention, there is provided an image forming apparatus comprising:

an image formation unit that forms an image on a recording medium with a color material;

a color material container that contains the color material; and a cooling air passage that a cooling air for cooling the color material container flows through, the color material container comprising at least a part of the cooling air passage.

BRIEF DESCRIPTION OF THE DRAWINGS

Embodiments of the present invention will be described in detail based on the following figures, wherein.

DETAILED DESCRIPTION

Hereinafter, exemplary embodiments of the invention will be described in detail with reference to drawings.

Figure 1:
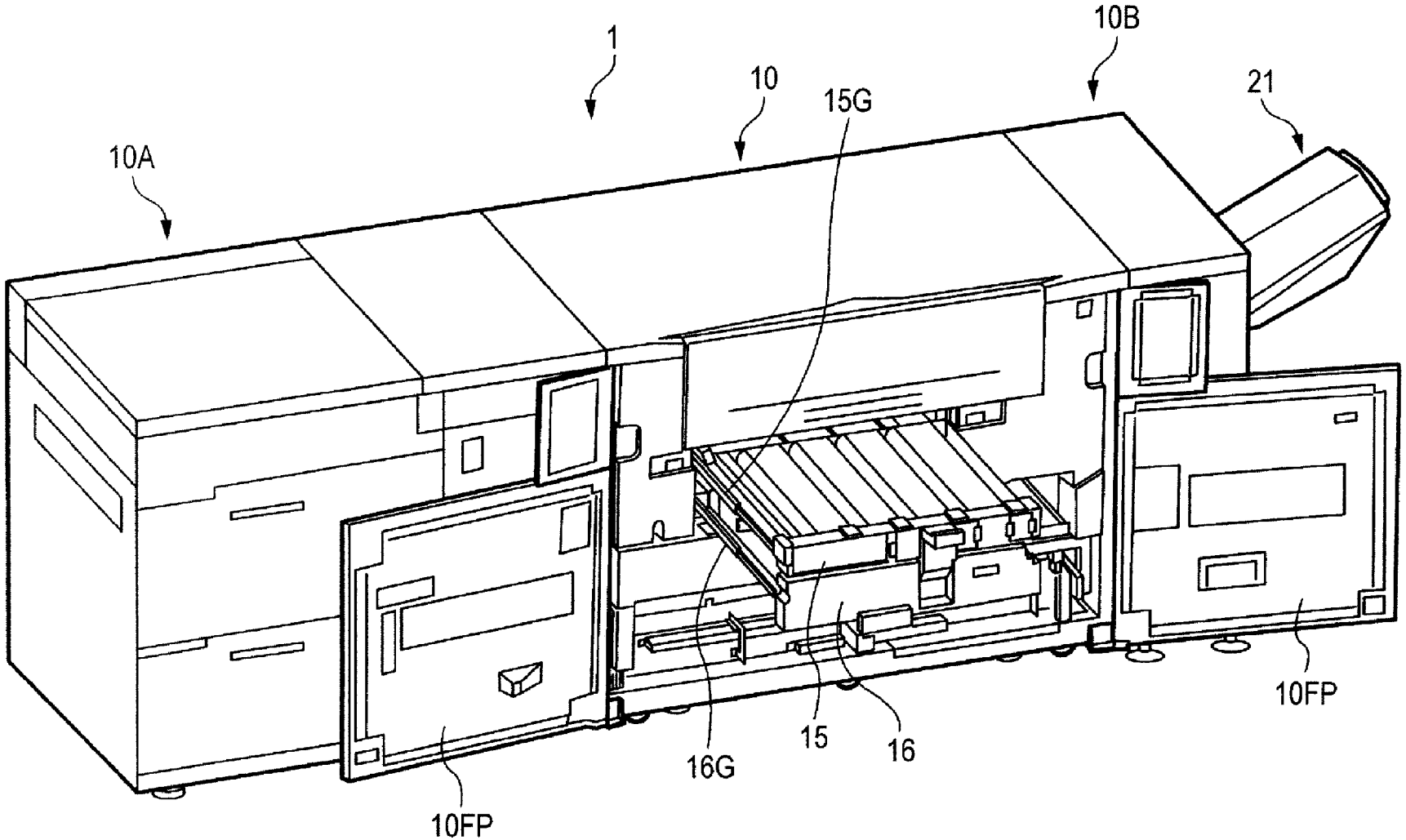
FIG. 1 is a perspective view showing an overall appearance of an image forming apparatus according to an exemplary embodiment of the invention.
Figure 2:
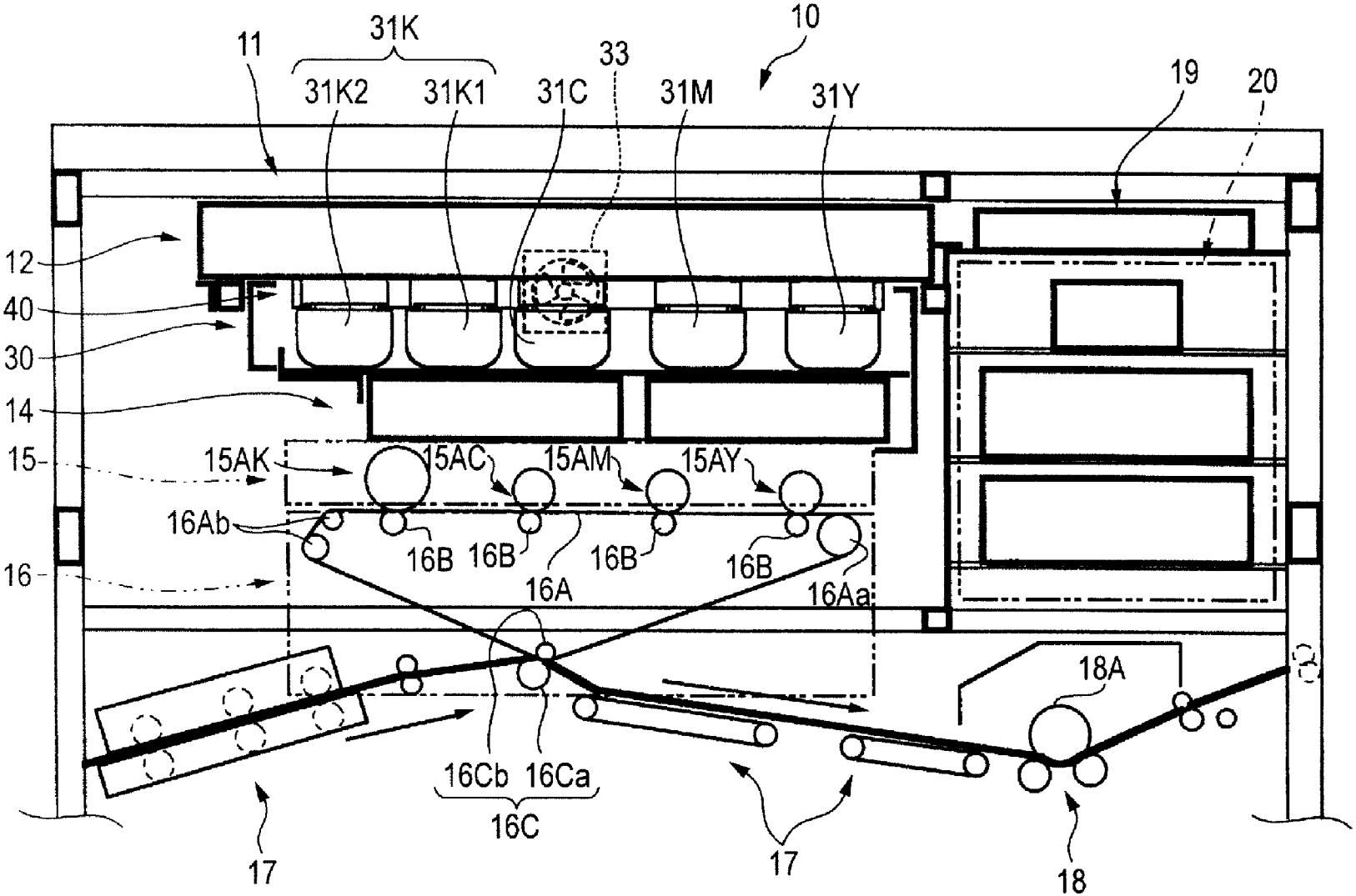
FIG. 2 is a schematic block diagram showing an image forming apparatus main body.

FIG. 1 is a perspective view showing an overall appearance of an image forming apparatus 1 according to an exemplary embodiment of the invention, and FIG. 2 is a conceptual block diagram showing an image forming apparatus main body 10 of the image forming apparatus 1.

The image forming apparatus 1 is a color image forming apparatus that forms a color image by means of plural image formation members 15A (15AY, 15AM, 15AC, 15AK) provided in the image forming apparatus main body 10 used as an image formation unit. The image forming apparatus 1 is provided with a sheet feeding device 10A shown on the left side in the drawing and a sheet discharge device 10B shown on the right side in the drawing with the image forming apparatus main body 10, which is at the central part, being placed therebetween.

Shown in FIG. 1 is a state wherein front panels 10FP on an operation surface (on the lower part of the drawing: front surface) of the image forming apparatus main body 10 is opened to the right and left and an image formation unit 15 and a transfer belt unit 16 described later in this specification are withdrawn in a direction of the operation surface.

In the following description, the operation surface of the image forming apparatus 1 is referred to as the front surface, and a back surface opposite to the front surface is referred to as a rear surface. Also, a depth direction from the front surface to the rear surface is referred to as a cross direction; a direction orthogonal to the cross direction is referred to as a horizontal direction; and a direction orthogonal to the cross direction and the horizontal direction is referred to as a vertical direction.

The image forming apparatus main body 10 has, in an interior part of a frame 11 assembled in the form of a substantially rectangular parallelepiped, mechanisms forming the image formation unit described below.

More specifically, the image forming apparatus main body 10 is provided with, from the upper left of FIG. 2, a control substrate assembly 12 which is a heat generating member in which electric circuit substrates forming a control device of the image forming apparatus 1 are assembled, a toner containing unit 30, a scan exposure device 14, the image formation unit 15, the transfer belt unit 16, and a sheet feeding mechanism 17. Also, in the lower right of FIG. 2, a fixing device 18 and a power distribution substrate assembly 19 positioned above the fixing device 18 are disposed. Further, a power source device 20 is disposed between the fixing device 18 and the power distribution substrate assembly 19.

The scan exposure device 14 is a so-called multi-beam scan optical system for scanning with collective plural laser beams emitted by a laser diode. The scan exposure device 14 is disposed above the image formation unit 15 and forms an electrostatic image by scanning the photoreceptor drums of the image formation members 15A by exposure with the plural laser beams.

The image formation unit 15 is provided with the four image formation members 15A (15AY, 15AM, 15AC, 15AK) for forming images of colors of yellow (Y), magenta (M), cyan (C), and black (K).

Each of the image formation members 15A is provided with a charging device for charging a periphery of the photoreceptor drum along a rotation direction of the photoreceptor drum used as an image retainer and a developing device for obtaining an toner image from an electrostatic image formed on the photoreceptor drum by the exposure by the scan exposure device 14, of which details are not shown. Also, each of the image formation members 15A is provided with a cleaner for removing a residual toner remaining on the photoreceptor drum after the transfer of the toner image onto an intermediate belt 16A of the transfer belt unit 16 described later in this specification. The electrostatic image formed on a photoreceptor on a surface of the photoreceptor drum is developed by the developing device to obtain the toner image.

The toner containing unit 30 is a color material container corresponding to the colors of yellow (Y), magenta (M), cyan (C), and black (K) and has toner cartridges 31 (31Y, 31M, 31C, 31K) which are toner containers. The toner containing unit 30 supplies the toners as required to the developing devices of the image formation members 15A of the image formation unit 15. An exhaust fan 33 for circulating a cooling air for cooling the toner cartridges 31Y, 31M, 31C, and 31K is provided at the rear of the toner containing unit 30. The toner containing unit 30 will be described in detail later in this specification.

The transfer belt unit 16 is provided with the intermediate transfer belt 16A which is hung rotatably, primary transfer rolls 16B corresponding to the image formation members 15A of the image formation unit 15, and a secondary transfer unit 16C transferring the toner image retained by the intermediate transfer belt 16A onto a recording sheet.

The intermediate transfer belt 16A is hung around a driving roll 16Aa, a backup roll 16Ab, and the like and rotates anticlockwise in FIG. 2 as being driven by the driving roll 16Aa. A rotation path above the intermediate transfer belt 16A is substantially linear in the horizontal direction, and the four image formation members 15A of the image formation unit 15 are aligned side by side as facing to the linear rotation path. The primary transfer rolls 16B are disposed at positions opposite to the photoreceptor drums of the image formation members 15A over the intermediate transfer belt 16A.

A primary transfer bias which has a polarity reverse to a charging polarity of the toner is applied to the primary transfer rolls 16B, and the toner images on the photoreceptor drums of the image formation unit 15A are electrostatically absorbed by the intermediate belt 16A for transcription.

The secondary transfer unit 16C is formed of a secondary transfer roll 16Ca positioned outside the lower rotation path of the intermediate transfer belt 16A and a backup roll 16Cb provided inside the rotation path. A secondary transfer bias is applied between the secondary transfer roll 16Ca and the backup roll 16Cb, so that the toner image carried by the intermediate transfer belt 16A is transferred (secondary transfer) onto the recording medium fed and supplied by the sheet feeding mechanism 17.

Each of the image formation unit 15 and the transfer belt unit 16 is structured as an independent unit, and it is possible to perform maintenance work on each of the image formation unit 15 and the transfer belt unit 16 by withdrawing each of them toward the front surface by way of guide rails 15G and 16G as shown in FIG. 1.

The sheet feeding mechanism 17 is formed of plural feed rolls, plural conveyers, and the like and disposed between the sheet feeding device 10A (see FIG. 1) disposed on the left part of the image formation apparatus main body 10 of FIG. 2 and the secondary transfer unit 16C as well as between the secondary transfer unit 16C and the fixing device 18. The sheet feeding mechanism 17 feeds a recording sheet stored in the sheet feeding device 10A to the secondary transfer unit 16C in synchronization with the toner image formation by the image formation members 15A of the image formation unit 15 and feeds the recording sheet on which toner image has been transferred in the secondary transfer unit 16C to the fixing device 18.

The fixing device 18 is provided with a fixing roll 18A which is heated, and the toner image is fixed on the recording sheet by bringing the recording sheet into a pressure-contact with the fixing roll 18A followed by heating and pressurizing.

The power source device 20 changes a voltage of an input current to output a power source current required for driving the above-described mechanisms.

The power distribution substrate assembly 19 distributes the current formed by the power source device 20 to the mechanisms.

The image forming apparatus 1 having the above-described structure performs image formation as described below with the mechanisms being controlled by the control device formed of the control substrate assembly 12.

More specifically, the color images formed by the image formation members 15A of the image formation unit 15 by the exposure by the scan exposure device 14 are overlapped sequentially on the intermediate transfer belt 16A rotatably driven by the transfer belt unit 16 in accordance with the motion of the intermediate transfer belt 16A, thereby forming a color toner image. A recording sheet supplied from the sheet feeding device 10A is fed timely with the movement of the intermediate transfer belt 16A to transfer the color toner image on the transfer belt unit 16 onto the recording sheet. After that, the recording sheet on which the color toner image has been transferred is fed to the fixing device 18 to fix the color toner image by the fixing device 18, and processings such as a curl correction are performed by the sheet discharge unit 10B, so that the recording sheet is discharged to a discharge tray 21 provided outside.

Hereinafter, the toner containing unit 30 which is a major part of this invention will be descried in detail with reference to FIGS. 3 to 5.

Figure 3:
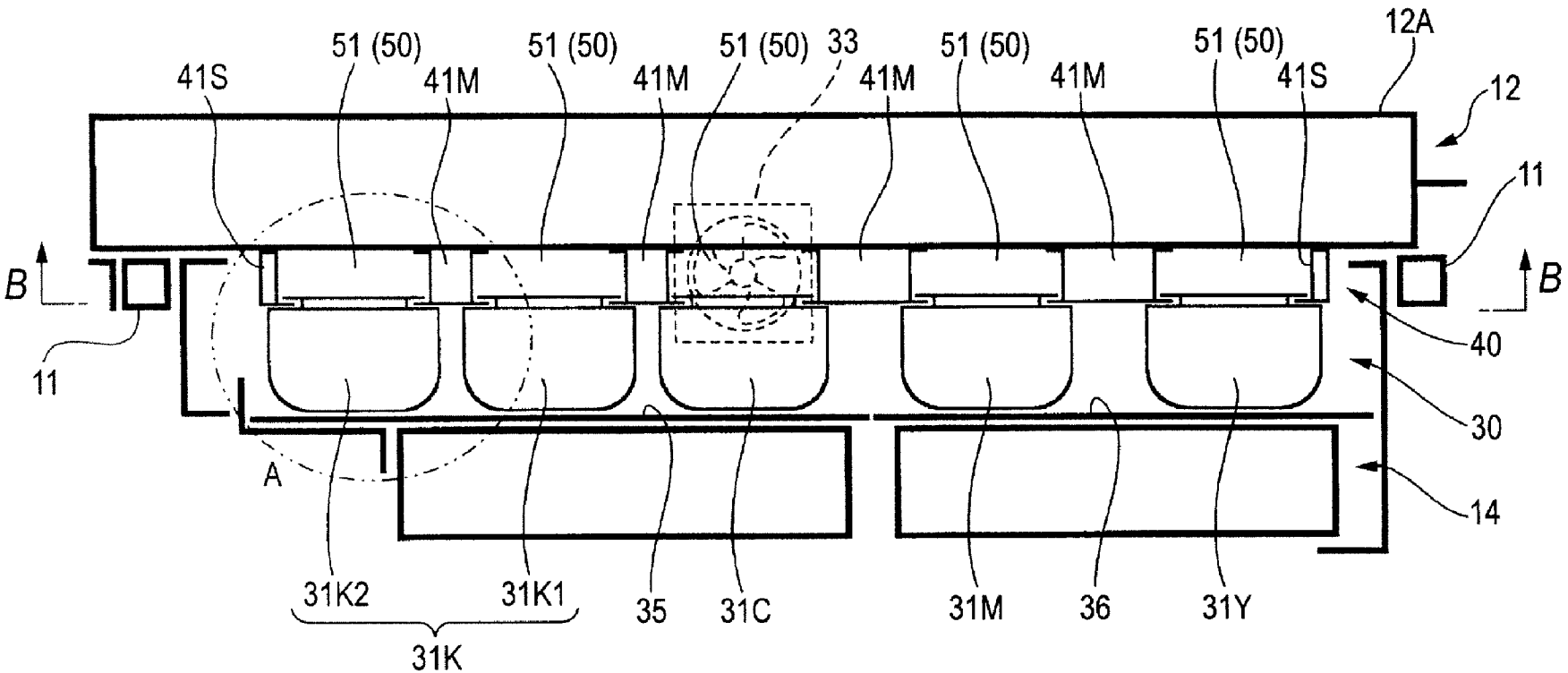
FIG. 3 is an enlarged view of a toner containing unit as viewed from the front.
Figure 4:
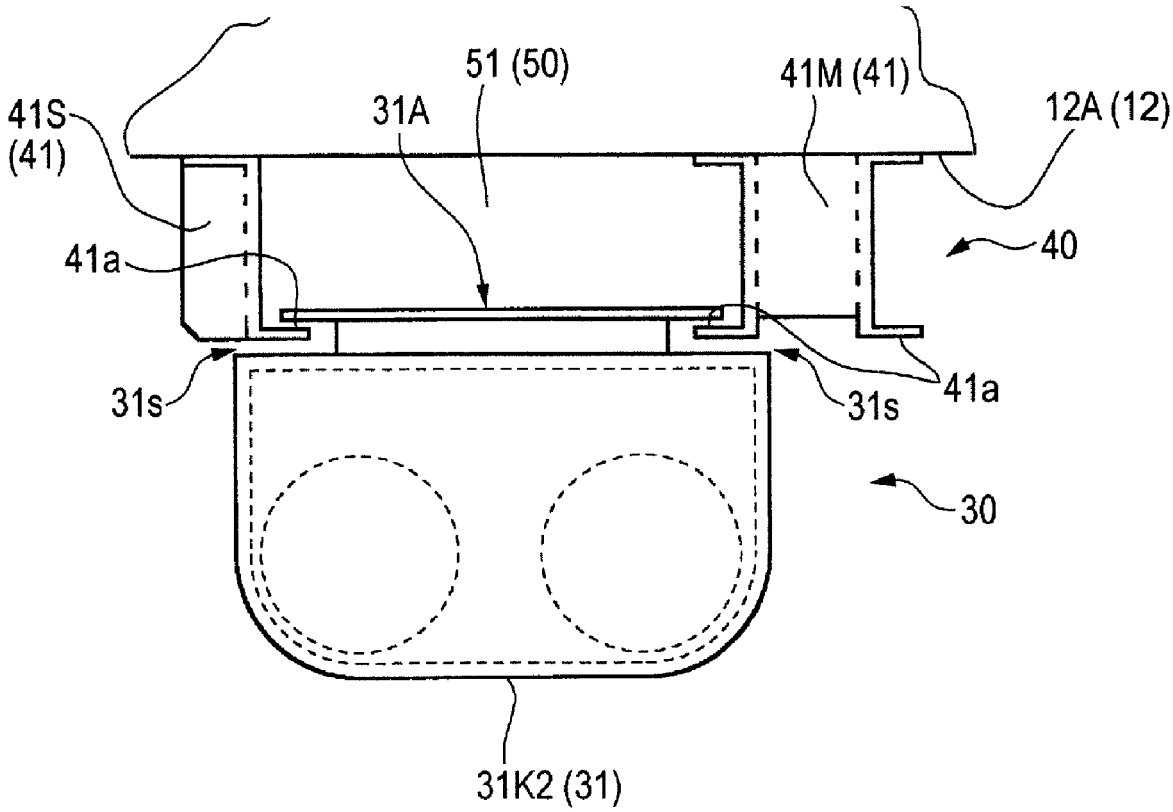
FIG. 4 is an enlarged view of a part A of FIG. 3.

FIG. 3 is a front enlarged view showing the toner containing unit 30, and FIG. 4 is an enlarged view showing a part A of FIG. 3. FIG. 5 is a sectional view taken along a line B-B of FIG. 3.

As described in the foregoing, the toner containing unit 30 is disposed under the control substrate assembly 12 and above the scan exposure device 14. This is because it is necessary to dispose the toner containing unit 30 above the image formation unit 15 in order to feed the toner by gravity and because it is difficult to dispose the toner containing unit 30 between the image formation unit 15 and the scan exposure device 14 due to the presence of an optical path for the scan exposure therebetween. The control substrate assembly 12 is disposed above the toner containing unit 30 in such a fashion as to shorten and approximate a length of signal transmission means as compared to the scan exposure device 14.

Such arrangement is preferable in terms of image signal transmission but subject to problems such as toner blocking (toner is solidified due to heat) and a reduction in fluidity of toner due to heat since the control substrate assembly 12 which is a heat generating part is positioned above the toner containing unit 30. In the case where an amount of heat generated from the heat generating part is increased by an increase in speed of image formation or in the case where a low melting point toner is used from the view point of energy conservation, the risk for occurrence the problems is increased.

In order to solve the above problems, a cooling air passage 50 is provided between each of the toner cartridges 31 (31Y, 31M, 31C, 31K) of the toner containing unit 30 and the control substrate assembly 12 in this exemplary embodiment.

Partitioning plates 35 and 36 are disposed between the toner containing unit 30 and the scan exposure device 14.

The toner containing unit 30 is provided with the toner cartridges 31 (31Y, 31M, 31C, 31K) corresponding to the colors of yellow (y), magenta (M), cyan (C), and black (K) as described in the foregoing.

In this exemplary embodiment, the toner cartridges having an identical shape are disposed in parallel to one another, and the two disposed on the left end in FIGS. 2 and 3 are the toner cartridges 31K (31K1, 31K2) for containing the black toner. Thus, the capacity for the black toner which is consumed rapidly is ensured.

Each of the toner cartridges 31 is supported by a mounting support member 40 formed on an undersurface of the control substrate assembly 12 positioned above the toner containing unit 30. The cooling air passage 50 for circulating the cooling air is formed between each of the toner cartridges 31 and the control substrate assembly 12. Each of the cooling air passages 50 is formed of a cartridge passage 51 extending in the cross direction corresponding to an upper surface of each of the toner cartridges 31 and a communication path 52 communicated in the horizontal direction, to which an end of a rear part of the cartridge passage 51 is connected as shown in FIG. 5.

The toner cartridge 31 has the shape of a substantially rectangular parallelepiped having a length that covers substantially a whole part of the frame 11 in the cross direction and is mounted on the mounting support member 40 as being inserted in the lengthwise direction from the front surface of the image forming apparatus main body 10. In a state where the toner cartridge 31 is disposed at the predetermined position, it is connected to a toner supply path (not shown) at a rear end thereof to supply the toner to the developing device of the corresponding color via the toner supply-path.

A fitting member 31A is formed on an upper surface of the toner cartridge 31, so that the toner cartridge 31 is mounted attachably/detachably on the mounting support member 40 by the fitting member 31.

The fitting member 31A is provided with a slit 31*s* opened laterally and continues in the cross direction (lengthwise direction of the toner cartridge 31) at each of left and right sides of the upper surface.

Each of the mounting support members 40 supporting the toner cartridge 31 is formed of plural support guides 41 (41M, 41S) provided on the undersurface of the control substrate assembly 12 and serving as support members.

The control substrate assembly 12 has the electric circuit substrates forming the control device which is housed in a housing 12A formed from a steel plate having an electromagnetic shielding property and the like. The electric component parts constituting the electric circuit substrate generate heat due to their function, and, therefore, the control substrate assembly 12 diffuses heat to outside of the housing 12A.

The housing 12A of the control substrate assembly 12 has the size that covers a whole part of the frame 11 in the cross direction and the image formation unit 15 and an upper surface of the transfer belt unit 16 in the horizontal direction and is fixed firmly to the frame 11. Therefore, the control substrate assembly 12 is provided in such a fashion as to cover the whole part of the upper portion of the toner containing unit 30.

Each of the support guides 41 forming the mounting support member 40 is fixed to the undersurface of the housing 12A of the control substrate assembly 12.

The support guides 41 include the intermediate guides 41M each positioned between the adjacent toner cartridges 31 and the side guides 41S each positioned outside the toner cartridges 31Y and 31K2 at the right and left ends.

Each of the intermediate guides 41M substantially has a sectional shape of a rectangle having a predetermined height and has support plate members 41*a* fitted into the slits 31*s* of the fitting part 31A of the relevant toner cartridge 31, the support plate members 41*a* being projected from left and right sides at a lower end of the intermediate guide 41M.

Each of the side guides 41S is in the form of a plate having a height equal to that of the intermediate guide 41M, and the support plate member 41*a* is projected from one side of the lower end (only on the side near the toner cartridge 31).

A length of the intermediate guide 41M in the cross direction is such that a front side thereof corresponds to a front end of the mounted toner cartridge 31 and a rear side is shorter than the rear end of the toner cartridge 31 by a predetermined length. In turn, a length in the cross direction of the side guide 41S is such that a front side corresponds to the front end of the mounted toner cartridge, and the rear side reaches to the rear side end of the control substrate assembly 12.

Each of the support guides 41 is formed by reinforcing a side plate forming an outer surface with a rib or the like and is not communicated in the cross direction (air does not flow therethrough).

The mounting support member 40 guides the attaching/detaching movements of the toner cartridge 31 with the use of the support guides 41 positioned at the left and right of the cartridge 31 and supports the toner cartridge 31 at a predetermined position. Each of the toner cartridges 31 is inserted in a direction of extension of the support guides 41 in such a fashion that support plate members 41*a* positioned at the right and left sides of each of the support guides 41 are fitted into the slits 31*s* of the fitting part 31A of the toner cartridge 31, so that the toner cartridge 31 is disposed at the predetermined position.

Due to the support structure for the toner cartridge 31 by the above-described mounting support member 40 (support guides 41), the cartridge passage 51 having the height identical with that of the support guides 41 is formed between the upper surface of each of the toner cartridges 31 supported at the predetermined position by the support guides 41 and the control substrate assembly 12 (housing 12A). More specifically, by mounting the toner cartridge 31 at the predetermined position, the cartridge passage 51 extending in the cross direction along the toner cartridge 31 is formed as being surrounded by the undersurface of the housing 12A of the control substrate assembly 12, the support guides 41, and the upper surface of the cartridge 31. Also, at a part in the rear of each of the cartridge passages 51, on which the intermediate guide 41M is not positioned, the communication path 52 communicated in the horizontal direction is formed, and the cartridge passage 51 is connected to the communication path 52 at one end in the rear thereof.

At a part in the rear and corresponding to the communication path 52, an exhaust fan 33 is mounted on the frame 11.

The exhaust fan 33 inhales the air inside the communication path 52 when driven and exhausts the air to the outside in the rear. Thus, a cooling air is drawn from the front surface side to pass through the cartridge passages 51 and to reach to the communication path 52 to be discharged to the outside in the rear.

In the toner containing unit 30 having the above-described structure, since the cooling air passages 50 (cartridge passages 51) are formed between the control substrate assembly 12 and the cartridges 31, the heat generated by the control substrate assembly 12 does not transmit to, nor heat the cartridges 31. Further, since the cooling air flows through the cartridge passages 51 by the driving of the exhaust fan 33, the cartridges 31 heated by a radiant heat or the like are cooled down to prevent the toners contained inside the cartridges 31 from being increased in temperature.

This invention is not limited to the above embodiment. For instance, though the number of the exhaust fan 33 for discharging the air from the cooling air passages 50 is one and the exhaust fan 33 is disposed at the central part of the communication path in the above-described embodiment, plural exhaust fans may be provided.

Figure 5:
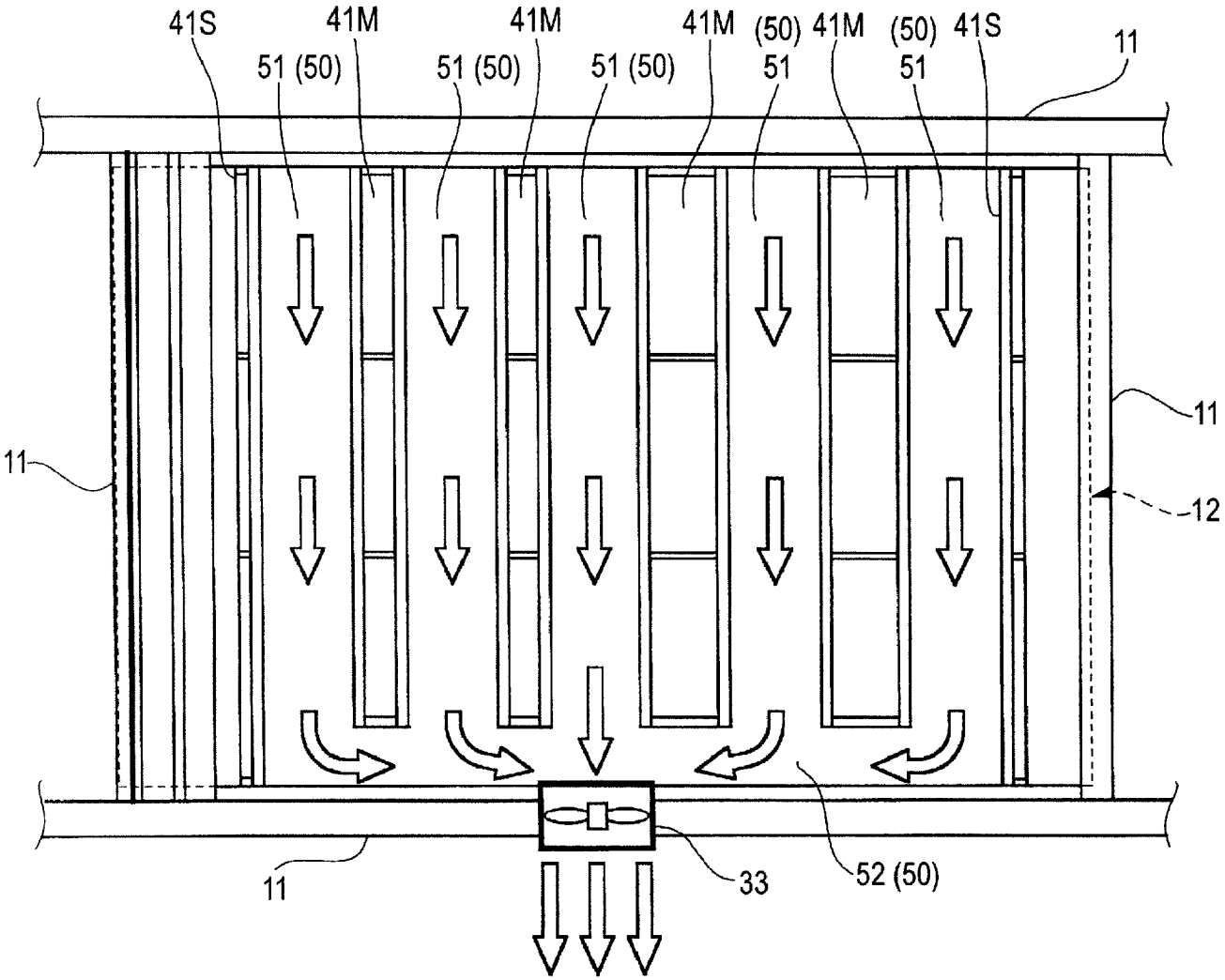
FIG. 5 is a sectional view taken along a line B-B of FIG. 3.
Figure 6:
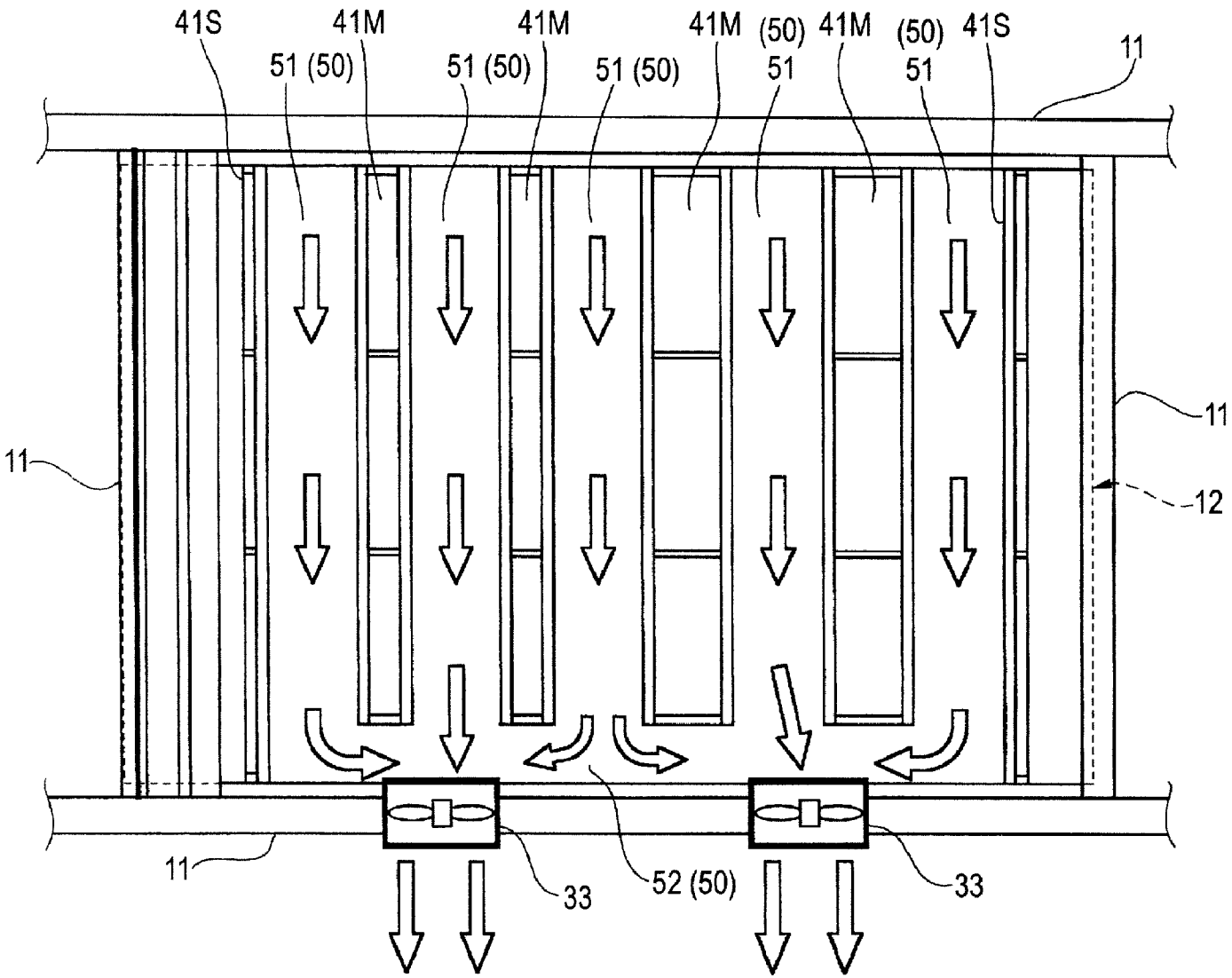
FIG. 6 is a diagram showing an exemplary embodiment of different structure which corresponds to FIG. 5.

FIG. 6 is a diagram corresponding to FIG. 5 and showing an exemplary embodiment of providing two exhaust fans 33.

As shown in FIG. 6, by using the two exhaust fans 33, it is possible to discharge air more efficiently. The exhaust fan 33 may be provided for each of the cartridge passages 51. Also, the exhaust fan 33 may be used as a fan for blowing a cooling air to the cooling air passages 50 (cartridge passages 51) not as the fan for discharging air from the cooling air passages 50 (cartridge passages 51). Further, the cooling air passages 50 (cartridge passages 51) may be inclined so as to cool down by means of a natural ventilation without using any fans.

The foregoing embodiment is one exemplary embodiment of adapting this invention to the tandem type color image forming apparatus, and this invention is not limited to the foregoing embodiment. For example, this invention may be adapted to a color image forming apparatus provided with a rotary type developing device and an image forming apparatus transferring an image on a recording medium directly from a photoreceptor drum without using any intermediate belt. Further, this invention may be adapted to apparatuses that form an image by the methods other than the electrophotography method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image formation unit that forms an image on a recording medium with a color material;

a color material container that contains the color material;

a cooling air passage that a cooling air for cooling the color material container flows through, the color material container comprising at least a part of the cooling air passage; and further comprising a heat generating member that generates heat, the cooling air passage being between the color material container and the heat generating member, and a support member supporting the color material container in such a fashion that the color material container is detachable, the support member comprising at least a part of the cooling air passage.

2. The image forming apparatus according to claim 1, wherein the heat generating member comprises an electric component part.

3. The image forming apparatus according to claim 1, wherein the heat generating member comprises an electric component part.

4. An image forming apparatus comprising:

an apparatus main body;

an image retainer that retains a toner image;

a developing device that forms the toner image on the image retainer;

a toner container that contains a toner to be supplied to the developing device, the toner container comprising an air cooling passage that cools the toner container in a state where the toner container is mounted on the apparatus main body;

a support member that supports the toner container in such a fashion that the toner container is detachable; and further comprising a heat generating member that generates heat, the cooling air passage being surrounded by the toner container, the support member, and the heat generating member.

5. The image forming apparatus according to claim 4, further comprising an exhaust fan at the rear of the toner container, the exhaust fan circulating the cooling air.

6. The image forming apparatus according to claim 4, further comprising two exhaust fans at the rear of the toner container, the two exhaust fans circulating the cooling air.

* * * * *